US009068254B2

(12) United States Patent
Kawamura et al.

(10) Patent No.: US 9,068,254 B2
(45) Date of Patent: Jun. 30, 2015

(54) FLOW REGULATING MEMBER OF HOT DIP COATING TANK AND CONTINUOUS HOT DIP COATING SYSTEM

(75) Inventors: Mikio Kawamura, Tokyo (JP); Yu Yamauchi, Tokyo (JP); Tsukasa Oyama, Tokyo (JP); Masaaki Omodaka, Tokyo (JP); Noboru Furuta, Tokyo (JP); Koichi Nishizawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 43 days.

(21) Appl. No.: 13/978,750

(22) PCT Filed: Jan. 16, 2012

(86) PCT No.: PCT/JP2012/050740

§ 371 (c)(1),
(2), (4) Date: Jul. 9, 2013

(87) PCT Pub. No.: WO2012/096401

PCT Pub. Date: Jul. 19, 2012

(65) Prior Publication Data

US 2013/0291793 A1 Nov. 7, 2013

(30) Foreign Application Priority Data

Jan. 14, 2011 (JP) ..... 2011-005847

(51) Int. Cl.

| | |
|---|---|
| ***B05C 3/00*** | (2006.01) |
| ***B05C 3/02*** | (2006.01) |
| ***C23C 2/00*** | (2006.01) |
| ***C23C 2/40*** | (2006.01) |
| ***C23C 2/06*** | (2006.01) |

(52) U.S. Cl.
CPC . *C23C 2/003* (2013.01); *C23C 2/40* (2013.01); *C23C 2/06* (2013.01)

(58) Field of Classification Search
USPC ..... 118/428, 423, 424, 429, 419; 427/431, 427/433, 434.2–434.5, 436
See application file for complete search history.

(56) References Cited

U.S. PATENT DOCUMENTS 2,742,019 A * 4/1956 Queer, Sr. ..... 118/429
2009/0183674 A1 7/2009 Kuwana et al.

FOREIGN PATENT DOCUMENTS

| | | |
|---|---|---|
| JP | 2000-054097 | 2/2000 |
| JP | 2002-069602 A | 3/2002 |
| JP | 2006-316346 | 11/2006 |
| JP | 2010-024472 | 2/2010 |
| WO | WO2007/139206 | 12/2007 |

OTHER PUBLICATIONS

International Search Report dated Apr. 17, 2012, issued in corresponding PCT Application No. PCT/JP2012/050740.

* cited by examiner

*Primary Examiner* — Yewebdar Tadesse
(74) *Attorney, Agent, or Firm* — Kenyon & Kenyon LLP

(57) ABSTRACT

A flow regulating member of a hot dip coating tank which is able to suppress stir-up of bottom dross, characterized by being provided with flow regulating member horizontal plates which are respectively arranged horizontally from below two side end parts of a sink roll, which is arranged inside of a coating tank in a rotatable manner, toward outside directions of the sink roll and side members which are arranged at positions separated from the two ends of the sink roll, which extend upward from the end parts of the respective horizontal plates, and in which large numbers of dispersion holes are formed, the side members having an aperture ratio of 20 to 80%, and the dispersion holes having a hole diameter of 5 to 50 mm.

9 Claims, 9 Drawing Sheets

FLOW REGULATING MEMBER OF HOT DIP COATING TANK AND CONTINUOUS HOT DIP COATING SYSTEM

This application is a national stage application of International Application No. PCT/JP2012/050740, filed Jan. 16, 2012, which claims priority to Japanese Application No. 2011-005847, filed Jan. 14, 2011, the content of which is incorporated by reference in its entirety.

TECHNICAL FIELD

The present invention relates to the art of inhibiting stir-up of bottom dross due to a flow of a hot dip coating metal occurring along with running of a steel sheet or rotation of a sink roll.

BACKGROUND ART

A hot dip galvanizing system which performs hot dip galvanization on a steel sheet, as shown in FIG. 10, is comprised of a coating tank 51 in which molten zinc 71 is filled and a sink roll 52 which is supported by roll support members 53 to hang down inside the coating tank 51 in a rotatable manner. A steel sheet 75 which enters the inside of the coating tank 51 from above is wound around the sink roll 52 whereby it is changed in direction to head upward and is pulled up from the coating tank 51. During this time, the surface of the steel sheet 75 has molten zinc deposited on it whereby a galvanized layer is formed.

If performing such hot dip galvanization, the iron which is eluted from the steel sheet and the molten zinc react whereby bottom dross 72 which is mainly comprised of an iron-zinc alloy is produced and deposits at the bottom of the coating tank 51. In such a hot dip galvanization process, as shown in FIG. 10(B), along with movement of the steel sheet 75 which enters the coating tank 51 from above, a flow in the direction of movement of the steel sheet 75 (below, referred to as a "trailing flow") is formed in the molten zinc 71 which contacts the steel sheet 75. The trailing flow of molten zinc 71, as shown in FIG. 10(A) runs into a dead end at the position where the steel sheet 75 and the sink roll 52 contact, is discharged to the lateral bottom sides of the sink roll 52, is reflected at the side walls of the coating tank 51 and flows downward, and stirs up the bottom dross 72.

If the bottom dross 72 is stirred up, the stirred up bottom dross 72 deposits on the surface of the steel sheet 75. The bottom dross 72 is hard, so at the time of rolling or working, the surface of the steel sheet 75 is formed with dents as bottom dross defects.

PLT 1 and PLT 2 propose the arts of preventing stir-up of bottom dross 72 and preventing bottom dross defects by providing flow regulating members which cover the bottom or sides of the sink roll 52 and blocking the flow of molten zinc 71 toward the lateral bottom sides of the sink roll 52 by the flow regulating members so as to prevent stir-up of the bottom dross 72.

PLT 3 proposes the art of providing the bottom of a sink roll 52 with a flow regulating member which is provided with a plurality of holes so as to prevent stir-up of the bottom dross 72.

CITATIONS LIST

Patent Literature

PLT 1: Japanese Patent Publication No. 2002-69602A
PLT 2: Japanese Patent Publication No. 2000-54097A
PLT 3: WO2007/139206

SUMMARY OF INVENTION

Technical Problem

The flow regulating members which are shown in PLT 1 and PLT 2 are attached to the roll support members 53 which support the sink roll 52 or to the bearing parts of the sink roll 52 (side members which are shown in PLT 2). Therefore, when pulling up the sink roll 52 from the coating tank 51 to replace the sink roll 52, the flow regulating members have to be detached from the roll support members 53 or the sink roll 52, so the work of replacement of the sink roll 52 becomes troublesome.

Further, when replacing the sink roll 52, the line has to be made to stop and the tension between the steel sheet and the sink roll 52 eased. The flow regulating members which are shown in PLT 1 and PLT 2 completely cover the bottom of the sink roll 52, so if easing the tension between the steel sheet and the sink roll 52, the drooping steel sheet will contact the flow regulating members and damage the steel sheet or the flow regulating members will break.

Further, the bearings of the sink roll 52 are comprised of ceramic. For this reason, to prevent cracking of the ceramic bearings due to sudden heat expansion, before immersing the sink roll 52 and the roll support members 53 in the molten zinc 71, a preheating step of gradually making the sink roll 52 and the roll support members 53 rise in temperature becomes necessary. If the flow regulating members are attached to the sink roll 52 and roll support members 53 at this time, energy is wasted for preheating the flow regulating members.

Furthermore, the flow regulating members entirely cover the bottom of the sink roll 52, so the bottom dross 72 which is produced builds up on the flow regulating members. The built up bottom dross 72 is stirred up by the flow of molten zinc 71 which accompanies rotation of the sink roll 52 and deposits on the surface of the steel sheet 75.

The flow regulating member which is shown in PLT 3 has the effect of attenuating the wall surface flow rate which occurs at the two side surface parts of the sink roll and stirs up the bottom dross. However, it does not have side plates serving as flow regulating plates. The effect is insufficient in particular when the running speed of the steel sheet is fast and when the running steel sheet is wide.

The present invention has as its task to solve the above problems and provide a flow regulating member of a hot dip coating tank which can suppress stir-up of bottom dross and provide a continuous hot dip coating system which uses the same.

Solution to Problem

The inventors worked to complete the above task by studying in depth the structure of a system for preventing stir-up inside of a continuous hot dip plating bath tank. As a result, they discovered as follows. By providing inside the plating bath tank a flow regulating member which comprises horizontal plates and side members which extend above the end parts of the bath tank wall side of the horizontal plates vertical to the horizontal plates and which are formed with large numbers of dispersion holes, the strong flow of the trailing flow can be weakened while passed by a two-stage mechanism. Therefore stir-up of the bottom dross can be effectively prevented.

That is, by using horizontal plates to attenuate the flow of the trailing flow while changing the direction of flow and using side members in which large numbers of dispersion holes are formed so as to further attenuate and disperse the flow of the trailing flow. Therefore, even if the trailing flow strikes the side walls of the coating tank, it no longer has enough strength to stir up the bottom dross and therefore the flow motion after the trailing flow strikes the wall surfaces of the plating system can be rendered harmless.

The present invention was made based on the above discoveries and has as its gist the following.

(1) A flow regulating member of a hot dip coating tank characterized by being provided with horizontal plates which are respectively arranged horizontally from below two side end parts of a sink roll, which is arranged inside of a coating tank in a rotatable manner, toward outside directions of the sink roll and side members which are arranged at positions separated from the two ends of the sink roll, which extend upward from the end parts of the respective horizontal plates, and in which large numbers of dispersion holes are formed, the side members having an aperture ratio of 20 to 80%, and the dispersion holes having a hole diameter of 5 to 50 mm.

(2) The flow regulating member of a hot dip coating tank of (1), characterized in that the side members have an aperture ratio in a range of 30 to 70 % and hole diameters in a range of 10 to 35 mm.

(3) A continuous hot dip coating system characterized by being provided with a flow regulating member of a hot dip coating tank of (1) or (2).

(4) The continuous hot dip coating system of (3), characterized in that a horizontal direction dimension from bearing parts of the sink roll in a steel sheet exit side direction is 300 mm or more and in that a horizontal direction dimension from bearing parts of the sink roll in a steel sheet entry side direction is 350 mm or more.

(5) The continuous hot dip coating system of (3) or (4), characterized in that a separation dimension from a bottom end of the sink roll to the horizontal plates is 100 to 160 mm.

(6) The continuous hot dip coating system of any of (3) to (5), characterized in that the horizontal plates are laid from below the end parts of the sink roll in inside directions of 0 to 15% of a barrel length of the sink roll.

(7) The continuous hot dip coating system of any of (3) to (6), characterized in that the flow regulating member is attached by the support members and horizontal members to edge faces of the hot dip coating tank.

Advantageous Effects of Invention

In the present invention, the flow regulating member of a hot dip coating tank is comprised of horizontal plates which are respectively arranged horizontally from below two side end parts of a sink roll, which is arranged inside of a coating tank in a rotatable manner, toward outside directions of the sink roll and side members which are arranged at positions separated from the two ends of the sink roll, which extend upward from the end parts of the respective horizontal plates, and in which large numbers of dispersion holes are formed. Therefore a trailing flow of molten zinc strikes the horizontal plates, flows changed in direction toward the outside directions, is dispersed by the dispersion holes of the side members in various directions at the outsides of the side members, and is attenuated in flow rate, so stir-up of the bottom dross is suppressed.

DESCRIPTION OF EMBODIMENTS

Figure 1:
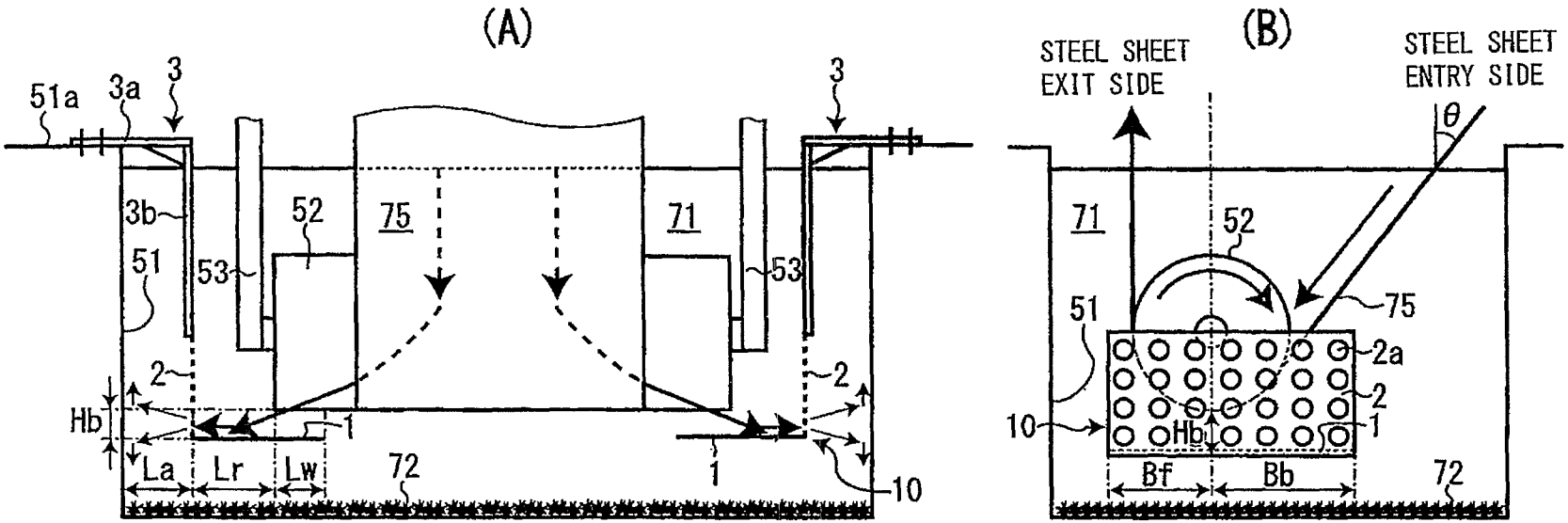
[FIG. 1] An explanatory view of a flow regulating member of a hot dip coating tank which shows an embodiment of the present invention.

Below, while referring to the drawings, preferable embodiments of the present invention will be shown. As shown in FIG. 1, a flow regulating member 10 of a hot dip coating tank of the present invention (below, simply referred to as the "flow regulating member 10") is comprised of horizontal plates 1 and members at their sides, that is, side members 2. The horizontal plates 1 are arranged from below two side ends of a sink roll 52 toward outside directions of the sink roll 52 in the horizontal direction. As shown in FIG. 1(A), the horizontal plates 1 are not positioned below a steel sheet 75.

As shown in FIG. 1(A), the side members 2 extend upward from the outside ends of the horizontal plates 1 and are arranged at positions separated from the two ends of the sink roll 52.

As shown in FIG. 1(B), the side members 2 are formed with large numbers of dispersion holes 2*a*. In the present embodiment, as one embodiment of the present invention, the side members 2 are so-called "punched metal sheets", and the dispersion holes 2*a* are round holes. Note that, the dispersion holes 2*a* which are formed in the side members 2 are not limited to round holes and may also be triangular holes, square holes, hexagonal holes, or other polygonal holes or elongated holes etc.

Further, the diameters of the dispersion holes 2*a* do not have to be constant from the sink roll sides of the side members 2 to the wall surface sides of the plating bath tank. For example, the holes may be shapes which gradually increase in diameters from the sink roll sides of the side members 2 to the wall surface sides of the plating bath tank or the opposite.

Note that, when the diameters of the dispersion holes 2*a* differ at the sink roll sides and the wall surface sides of the plating bath tank, the "hole diameter" which is defined in the present invention shall mean the diameter at the sink roll sides. Further, when a dispersion hole 2*a* is not a round hole, the "hole diameter" shall mean the circle equivalent diameter of the dispersion hole 2*a* which is calculated from the area of the hole.

As shown in FIG. 1(A), the flow regulating member 10 which is comprised of the horizontal plates 1 and the side members 2 is supported by support members 3 which are attached to the coating tank 51. In other words, the flow regulating member 10 is not attached to the sink roll 52 or roll support members 53 which support the sink roll 52. For this reason, when replacing the sink roll 52, the flow regulating member 10 is not pulled up from the coating tank 51, so the work of replacement of the sink roll 52 does not become troublesome.

In the present embodiment, as shown in FIG. 1(A), the support members 3 are comprised of horizontal members 3*a* which are attached to edge faces 51*a* of the coating tank 51 and extend to the inside of the coating tank 51 in the horizontal direction and vertical members 3*b* which hang down from the front ends of the horizontal members 3*a* and which support the side members 2.

Figure 2:
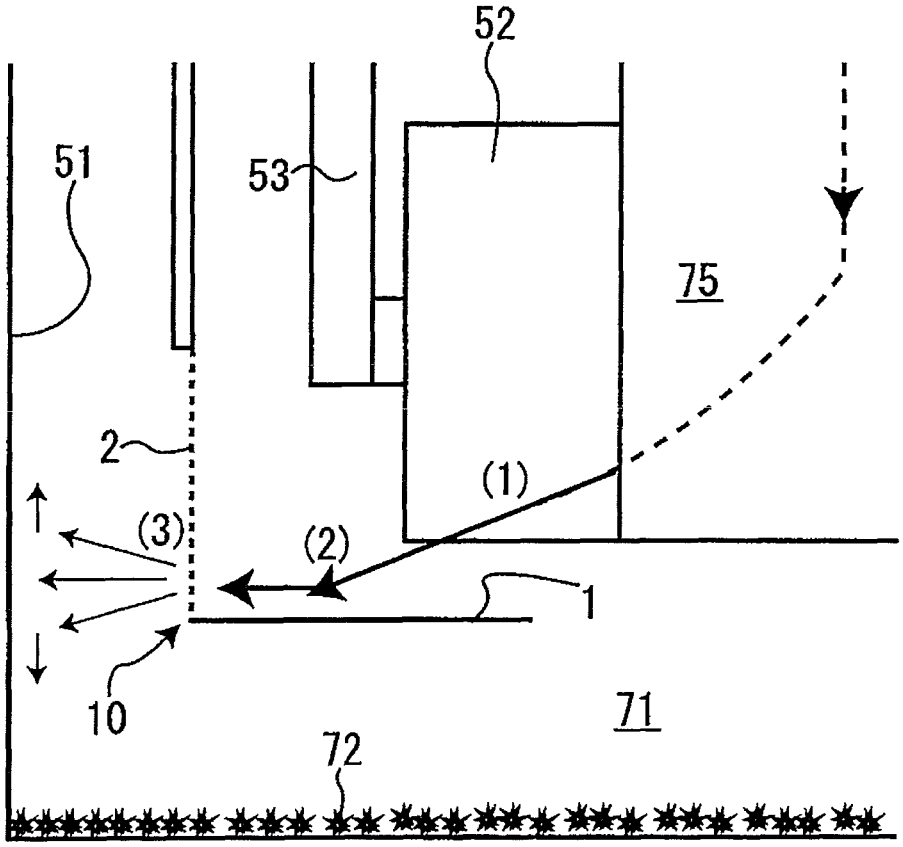
[FIG. 2] An explanatory view of the action of a flow regulating member of a hot dip coating tank of the present invention.

Next, using FIG. 2, the action of the flow regulating member 10 of the present invention will be explained. As shown in FIG. 2, (1), a trailing flow of the molten zinc 71 which is discharged to a lateral bottom side of the sink roll 52 strikes a horizontal plate 1 and, while having some upward directed components, flows changed in direction to the outside direction of the horizontal plate 1 (side member 2 direction) (FIG. 2, (2)). At this time, the flow rate of the trailing flow is attenuated. Further, if the trailing flow reaches the side member 2, the trailing flow is dispersed by the dispersion holes 2*a* of the side member 2 to various directions at the outside of the side member 2 and flows to the wall surface direction of the coating tank 51 (FIG. 2, (3)). Even if the trailing flow strikes the wall surface of the coating tank 51, the trailing flow is sufficiently dispersed and the flow rate is attenuated, so stir-up of the bottom dross 72 is suppressed.

The horizontal plates 1 are flat plate shapes and are arranged in the horizontal direction, so dross will almost never accumulate on the horizontal plates 1. However, when operation is stopped etc., slight dross may accumulate, so the horizontal plates 1 may also be provided with holes. Even if the horizontal plates 1 are provided with holes, the trailing flow will strike the horizontal plates 1 at a slant, so the mechanism by which the flow rate is attenuated and the direction of flow is changed to an upward direction will work. When the running speed is fast, the trailing flow which passes through the holes easily causes dross to be stirred up, so the horizontal plates 1 are preferably flat plates with no holes.

Below, using FIG. 3 and Table 1,the advantageous effects of the flow regulating member 10 of the present invention will be explained. The inventors ran tests on a flow regulating member of a hot dip coating tank wherein they filled water into a water tank representing a coating tank, caused the precipitation of tracers 73 simulating bottom dross, and matched the Froude number in a coating tank in actual operation and the Froude number in the water tank representing the coating tank (water model test) so as to study various structures. In the water model tests, as the tracers, they used acryl particles of a particle size of 10 to 300 μm and density of 1050 $kg/m^3$, while for the stir-up of the precipitated tracers, they used a commercially available solution particle counter which enables the range of particle size and the number of particles to be counted by a laser scattering method. For evaluating the stir-up of the tracers 73 simulating the bottom dross, a dross stir-up index Dr was used. Here, the "dross stir-up index Dr" is the dimensionless index which is represented by the following formula (1).

$$Dr = \text{number of tracers of particle size of 50 μm or more stirred up} / \text{Total number of stirred up tracers} \quad (1)$$

TABLE 1

| Structure | A: Roll bottom members | B: Side members | Bottom dross stir-up index |
|---|---|---|---|
| (1) | No roll bottom members | No side members | 1.0 |
| (2) | Horizontal plates | Flat plates (no holes) | 0.8 |
| (3) | Punched metal sheets | Flat plates (no holes) | 0.6 |
| (4) | Punched metal sheets | No side members | 0.4 |
| (5) | Punched metal sheets | Punched metal sheets | 0.4 |
| (6) | Horizontal plates | Punched metal sheets | 0.2 |

Figure 3:
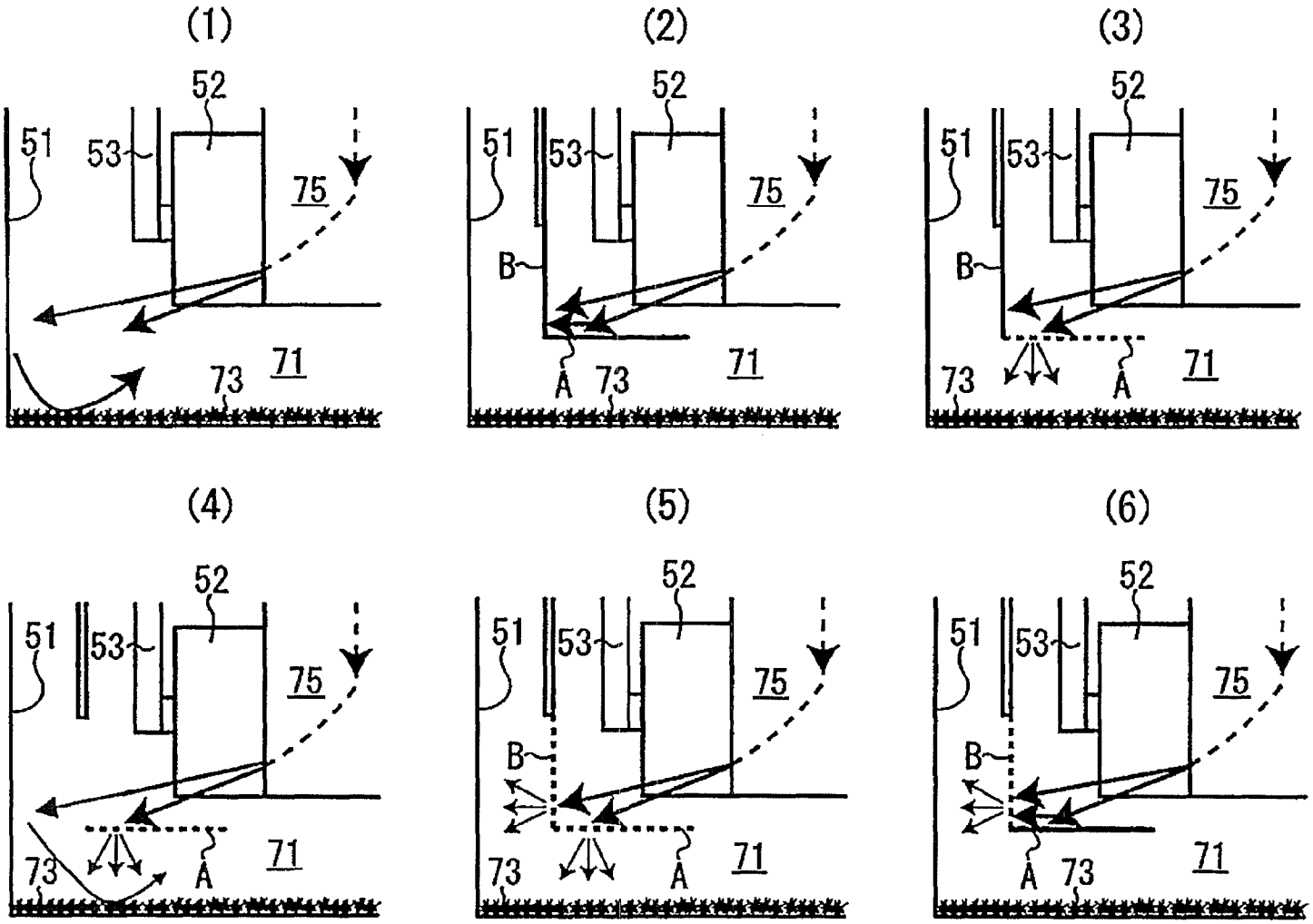
[FIG. 3] An explanatory view which shows the advantageous effect of the present invention.

As shown in FIG. 3, (2), when forming the roll bottom member A and side member B by flat plates, the trailing flow of the molten zinc 71 which is discharged to the lateral bottom side of the sink roll 52 strikes and is reflected at the roll bottom member A and side member B (flat plates (no holes)), is discharged along the flow of the steel sheet 75 from the deepmost part of the horizontal plate 1 (paper depth side), and stirs up the tracers 73 which simulated the bottom dross.

FIG. 3, (3) shows a case when forming the roll bottom member A by a punched metal sheet and the side member B by a flat plate (no holes). In this case, the trailing flow of the molten zinc 71 which is discharged to the lateral bottom side of the sink roll 52 becomes a downward flow which is dispersed by the punched metal sheet comprising the roll bottom member A and a downward flow which strikes and is reflected at the side member B and flows down from the part of the center bottom of the roll with no roll bottom member A. In this case as well, the stir-up of the bottom dross 72 by the trailing flow is reduced compared with the case of no roll bottom member A and side member B (FIG. 3, (1)), but the trailing flow which is dispersed and flows downward stirs up the tracers 73 simulating the bottom dross.

As shown in FIG. 3, (4), when making the roll bottom member A a punched metal sheet and eliminating the side member B, the trailing flow of the molten zinc 71 which is discharged to the lateral bottom side of the sink roll 52 includes a flow which is dispersed by the roll bottom member A and flows downward and a flow which directly strikes the wall surface or is reflected at the roll bottom member A and then strikes it. At this time, the trailing flow which strikes the wall surface and flows downward stirs up the tracers 73 simulating the bottom dross.

As shown in FIG. 3, (5), when making the roll bottom member A and side member B punched metal sheets, the main flow of the trailing flow of the molten zinc 71 which is discharged to the lateral bottom side of the sink roll 52 is dispersed by the punched metal sheets comprising the roll bottom member A and side member B. However, when the running speed is fast, part of the trailing flow which is dispersed at the roll bottom member A and flows downward stirs up the tracers 73 simulating the bottom dross.

As shown in FIG. 3, (6), when making the roll bottom member A a flat plate (no holes) and making the side member B a punched metal sheet, the amount of stir-up of the tracers 73 simulating the bottom dross becomes the smallest.

Next, the preferable sizes and installation locations of the horizontal plates serving as the roll bottom members and the side members comprised of the punched metal sheets will be explained.

In general, a sink roll 52 has an outside diameter of 600 to 1000 mm (mostly 800 mm or so) and a width dimension of 1800 to 2800 mm (mostly 2300 mm or so). In this case, the side members 2 are arranged separated from the ends of the sink roll 52 by 200 to 800 mm or so.

Below, the optimum dimensions when the sink roll 52 has the above dimensions will be explained. Note that, the entry angle θ of the steel sheet from the vertical direction is usually 25 to 40° or so. The steel sheet 75 which is wound around the sink roll 52 has a width of 600 to 2000 mm.

Figure 4:
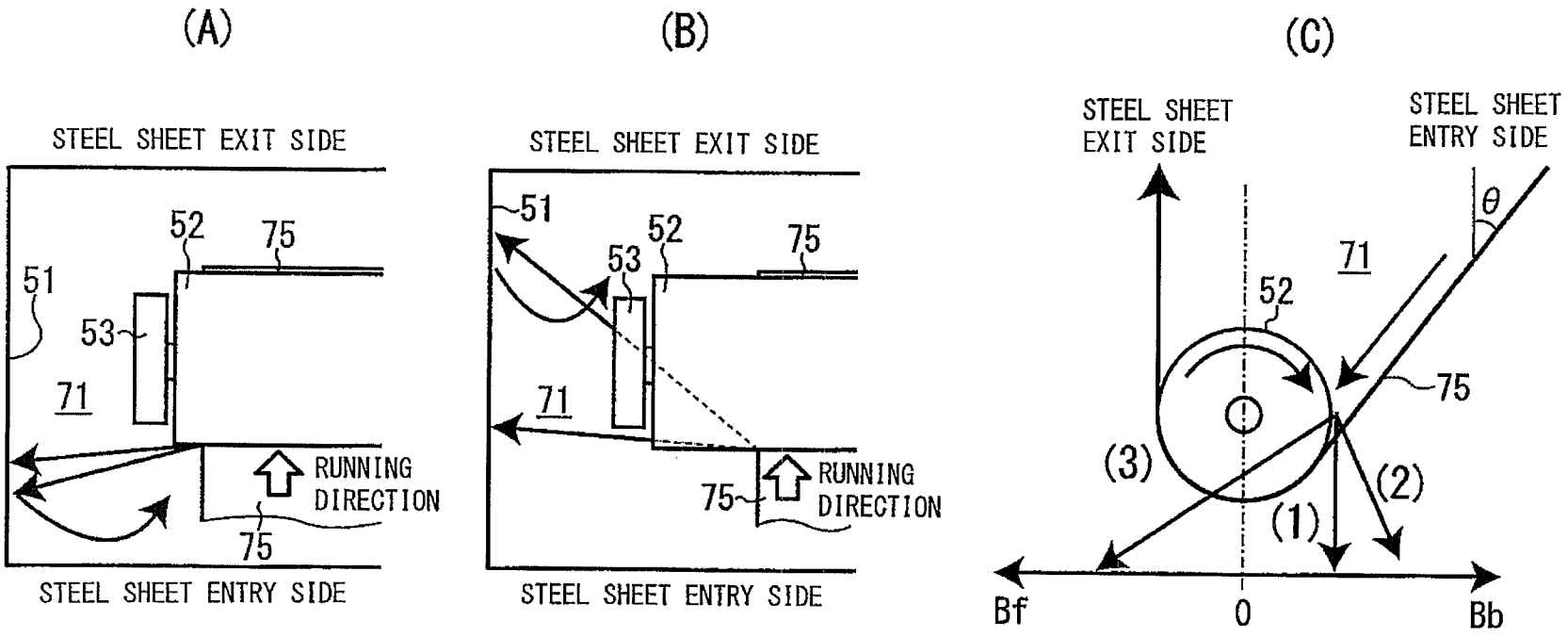
[FIG. 4] An explanatory view of a flow of a trailing flow.

Note that, FIGS. 4(A) and (B) are top views of the coating tank 51, while FIG. 4(C) is a side view of a sink roll 52.

When the steel sheet 75 is large in width, as shown in FIG. 4(A), the trailing flow of the molten zinc 71 is discharged from the position where the steel sheet 75 and the sink roll 52 contact to the back and lateral bottom sides of the sink roll 52. If viewing this from the side of the sink roll 52, as shown in FIG. 4(C), (2) the trailing flow of the molten zinc 71 flows downward at the steel sheet entry side from the position where the steel sheet 75 and the sink roll 52 contact. Further, as shown in FIG. 4(C), (1), part of the trailing flow of the molten zinc 71 flows downward toward the sink roll 52 from the position where the steel sheet 75 and the sink roll 52 contact. In this way, when the steel sheet 75 is large in width, the trailing flow of the molten zinc 71 flows toward the back side and the bottom side of the coating tank 51, strikes the side surfaces of the coating tank 51, then changes in direction toward the bottom side of the coating tank 51 and flows downward, and stirs up the bottom dross 72 which deposited at the bottom of the coating tank 51.

When the steel sheet 75 is small in width, as shown in FIG. 4(B), the trailing flow of the molten zinc 71 is discharged to the front and to the lateral bottom side of the sink roll 52 at the position where the steel sheet 75 and the sink roll 52 contact. If viewing this from the side of the sink roll 52, as shown in FIG. 4(C), (3), the trailing flow of the molten zinc 71 flows downward at the steel sheet exit side from the position where the steel sheet 75 and the sink roll 52 contact. Further, as shown in FIG. 4(C), (1), the trailing flow of the molten zinc 71, in the same way as when the steel sheet 75 is large in width, flows toward the bottom of the sink roll 52 from the position where the steel sheet 75 and the sink roll 52 contact. In this way, when the steel sheet 75 is small in width, the trailing flow of the molten zinc 71 flows toward the front and toward the bottom of the coating tank 51, strikes the side surface of the coating tank 51, then changes direction to the bottom side of the coating tank 51 and stirs up the bottom dross 72 which is deposited at the bottom of the coating tank 51.

In this way, depending on the width of the steel sheet 75 which is wound around the sink roll 52, the direction of flow of the trailing flow of the molten zinc 71 changes. For this reason, the side members 2 have to be able to handle the flows which are created from all widths of steel sheets 75 which are wound around the sink roll 52. As shown in FIG. 1(B) and FIG. 4(C), the preferable width direction dimensions of the side members 2 will be explained for the case of designating the horizontal direction dimension from the bearing parts of the sink roll 52 to the steel sheet exit side direction as "Bf" and designating the horizontal direction dimension from the bearing parts of the sink roll 52 to the steel sheet entry side direction as "Bb".

If the Bf dimension is smaller than 300 mm or the Bb dimension is smaller than 350 mm, depending on the width of the steel sheet 75, much of the trailing flow of the molten zinc 71 will not strike the side members 2, but will leak out from the side members 2. Therefore, the preferable width direction dimensions of the side members 2 are a Bf dimension of 300 mm or more and a Bb dimension of 350 mm or more. Note that, if the Bf dimension is larger than 500 mm or if the Bb dimension is larger than 850 mm, no further improvement in the effect of dispersion of the trailing flow by the side members 2 can be obtained. Further, depending on the variation in flow of the trailing flow of the molten zinc 71, even if setting the side members 2 to the preferable width dimensions, the trailing flow of the molten zinc 71 is liable to leak out from the side members 2. Therefore, it is more preferable to add 100 mm to the preferable width dimensions of the side members 2. Therefore, the preferable width dimensions of the side members 2 are a Bf dimension of 400 to 500 mm and a Bb dimension of 450 to 850 mm.

Note that, the height of the top ends of the side members 2 from the bottom of the coating tank 51 is preferably made approximately the same height as the bearing parts of the sink roll 52. If the top end positions of the side members 2 are lower than the bearing parts of the sink roll 52, the trailing flow of the molten zinc 71 is liable to leak out from the side members 2. On the other hand, even if making the top end positions of the side members 2 higher than the bearing parts of the sink roll 52 (for example, 50 mm or more from the axial center of the sink roll), no further effect of suppression of stir-up of bottom dross can be obtained.

Figure 5:
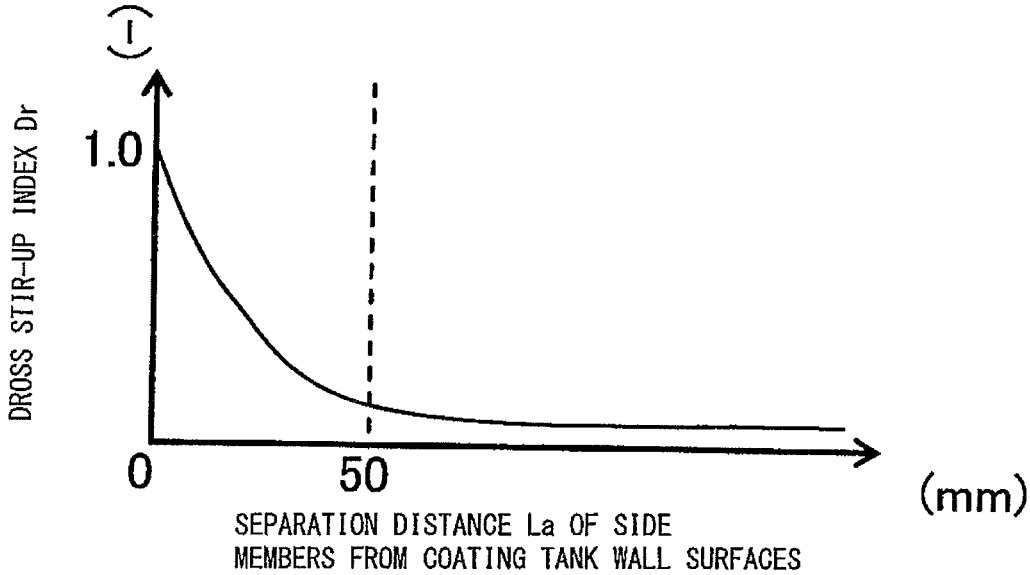
[FIG. 5] A graph which shows a relationship between a separation dimension of side plates from wall surfaces of a coating tank and a dross stir-up index.

Below, using FIG. 5, the optimum separation distance of the side members 2 from the wall surfaces of the coating tank 51 will be explained. The graph of FIG. 5 is a graph which shows the relationship between the separation dimension La of the side members 2 from the wall surfaces of the coating tank 51 (shown in FIG. 1(A)) and the dross stir-up index Dr while expressing the dross stir-up index. Dr at La=0 mm as "1.0". When obtaining the data of FIG. 5, the above-mentioned water model test was performed.

As shown in the graph of FIG. 5, if the side members 2 approach the wall surfaces of the coating tank 51 too much, the dispersion effect of the trailing flow of the molten zinc 71 by the side members 2 can no longer be obtained. As shown in the graph of FIG. 5, if the separation dimension La of the side members 2 and the wall surfaces of the coating tank 51 becomes smaller than 50 mm, the dross stir-up index suddenly rises. Therefore, the separation dimension La of the side members 2 and the wall surfaces of the coating tank 51 is preferably 50 mm or more.

Figure 6:
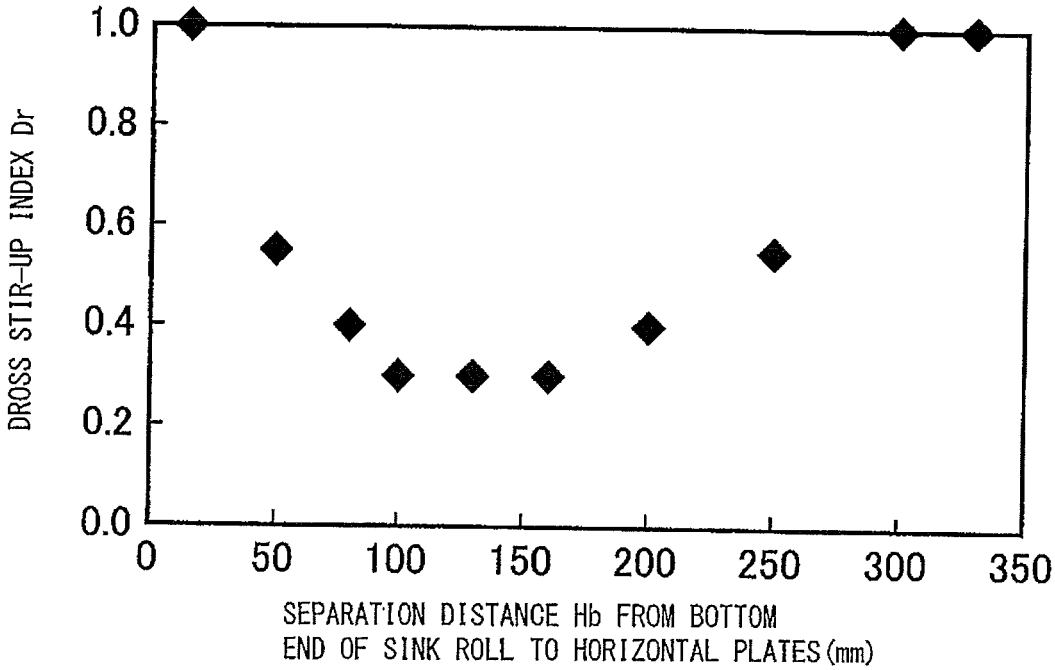
[FIG. 6] A graph which shows a relationship between a separation dimension of a flow regulating member from a bottom end of a sink roll and a dross stir-up index.

Below, using FIG. 6 and FIG. 7, the optimum separation distance from the bottom end of the sink roll 52 to the horizontal plates 1 will be explained. The graph of FIG. 6 is a graph which shows the relationship between the separation dimension Hb of the horizontal plates 1 from the bottom end of the sink roll 52 (shown in FIG. 1(B) or FIG. 9) and the dross stir-up index Dr while expressing the dross stir-up index Dr at Hb=15 mm as "1". When obtaining the data of FIG. 6, the above-mentioned water model test was performed.

As shown in FIG. 6, when the separation dimension Hb of the horizontal plates 1 from the bottom end of the sink roll 52 is 100 to 160 mm, the dross stir-up index Dr becomes the smallest. The reason will be explained using FIG. 7.

Figure 7:
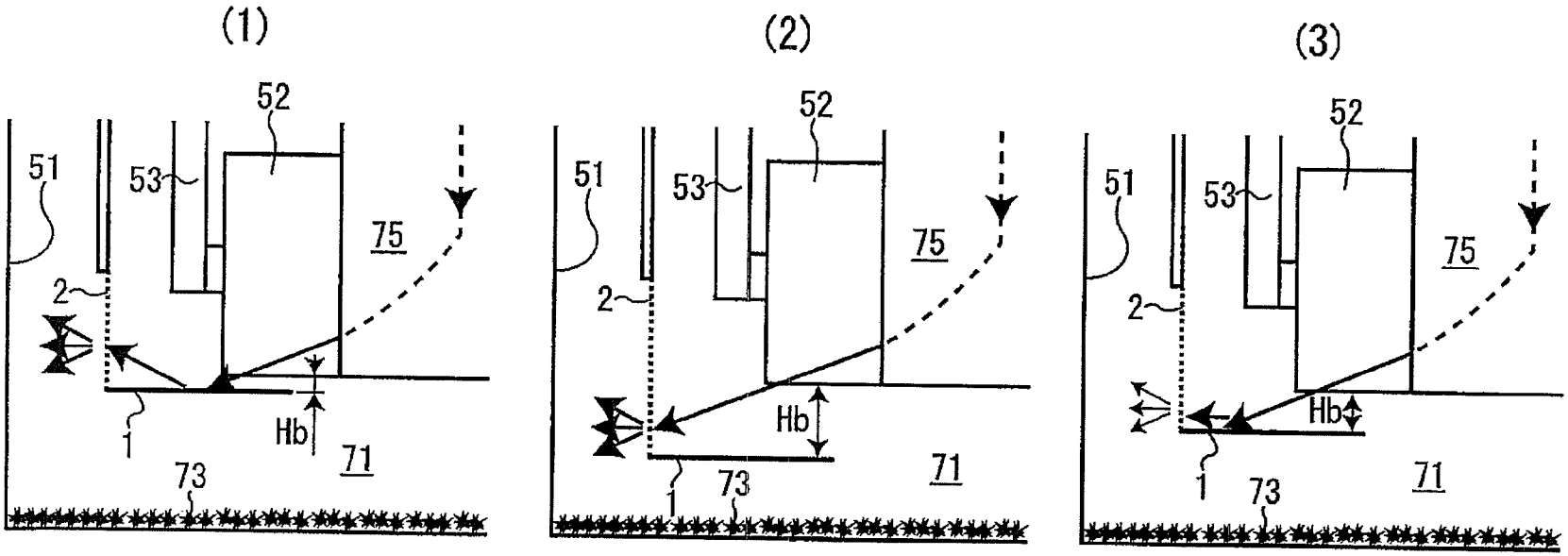
[FIG. 7] An explanatory view of an optimum separation distance of a flow regulating member from a bottom end of a sink roll.

As shown in FIG. 7, (1), when the separation dimension Hb of the flow regulating member from the bottom end of the sink roll 52 is small, the trailing flow of the molten zinc 71 which is discharged to the lateral bottom sides of the sink roll 52 at the position where the steel sheet 75 and the sink roll 52 contact immediately strikes the horizontal plates 1. As a result, the attenuation of the trailing flow at the horizontal plates 1 becomes insufficient and a trailing flow with a fast flow rate strikes the side members 2, so with dispersion by the side members 2, the trailing flow cannot be sufficiently attenuated.

On the other hand, as shown in FIG. 7, (2), when the separation dimension Hb of the horizontal plates 1 from the bottom end of the sink roll 52 is large, the trailing flow of the molten zinc 71 which is discharged to the lateral bottom sides of the sink roll 52 at the position where the steel sheet 75 and the sink roll 52 contact does not strike the horizontal plates 1, but directly strikes the side members 2. As a result, a trailing flow with a fast flow rate strikes the side members 2, so with just dispersion by the side members 2, the trailing flow cannot be sufficiently attenuated.

As shown in FIG. 7, (3), when the separation dimension Hb of the flow regulating member from the bottom end of the sink roll 52 is the optimum value, the trailing flow of the molten zinc 71 which is discharged to the lateral bottom sides of the sink roll 52 at the position where the steel sheet 75 and the sink roll 52 contact strikes the horizontal plates 1 to be attenuated. Furthermore, the trailing flow which has become slower in flow rate strikes the side members 2. As a result, by dispersion at the side members 2, the trailing flow can be sufficiently attenuated.

Next, using FIG. 1, the optimum width dimension of the horizontal plates 1 will be explained. As shown in FIG. 1(A), the horizontal plates 1 are laid from below the end parts of the sink roll 52 in the inside directions by exactly a predetermined dimension Lw. Lw is preferably 0 to 15% of the barrel length of the sink roll 52. If Lw is larger than 15% of the barrel length of the sink roll 52, when making the line stop and the steel sheet 75 droops down, the steel sheet 75 may contact the horizontal plates 1. On the other hand, when the end parts of the horizontal plates 1 are not below the end parts of the sink roll 52, the trailing flow of the molten zinc 71 which is discharged to the lateral bottom sides of the sink roll 52 at the position where the steel sheet 75 and the sink roll 52 contact is liable to not strike the horizontal plates 1 and to stir up the bottom dross 72.

Further, the distance between the horizontal plates 1 and the bottom of the coating tank is also not particularly limited. It is sufficient that a space be suitably maintained. Basically, if the coating tank is sufficiently deep, the problem of stir-up does not arise, but if making the coating tank deeper, a large amount of molten metal becomes necessary and the cost becomes high, so the depth of the coating tank is limited to a certain extent. The distance between the horizontal plates 1 and the bottom of the coating tank is usually 500 to 1500 mm or so.

Figure 8:
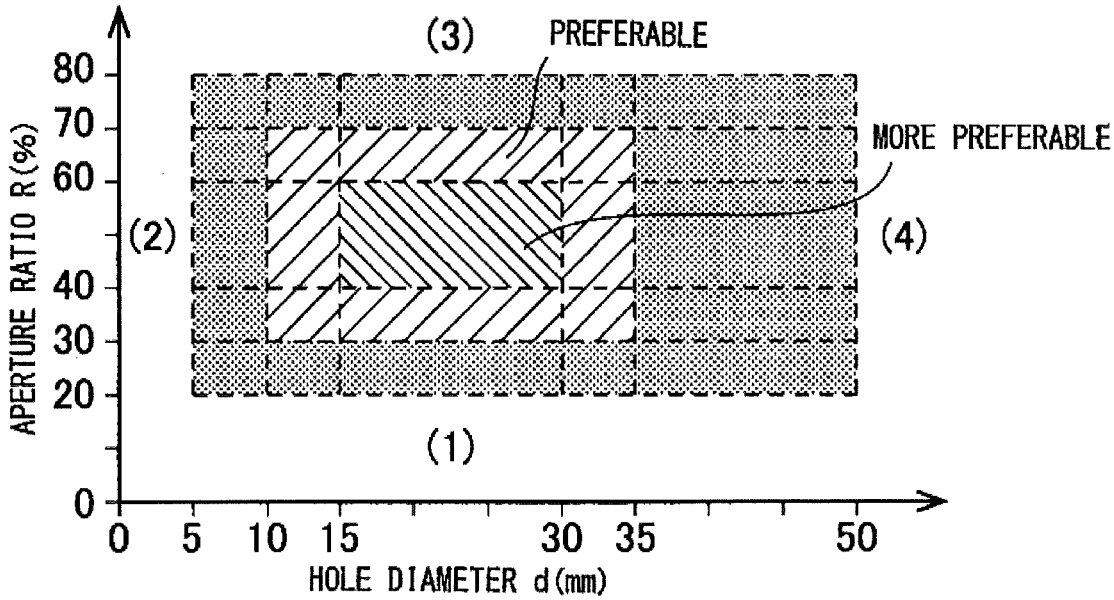
[FIG. 8] An explanatory view which shows an aperture ratio and hole diameter of dispersion holes of side members.
Figure 8:
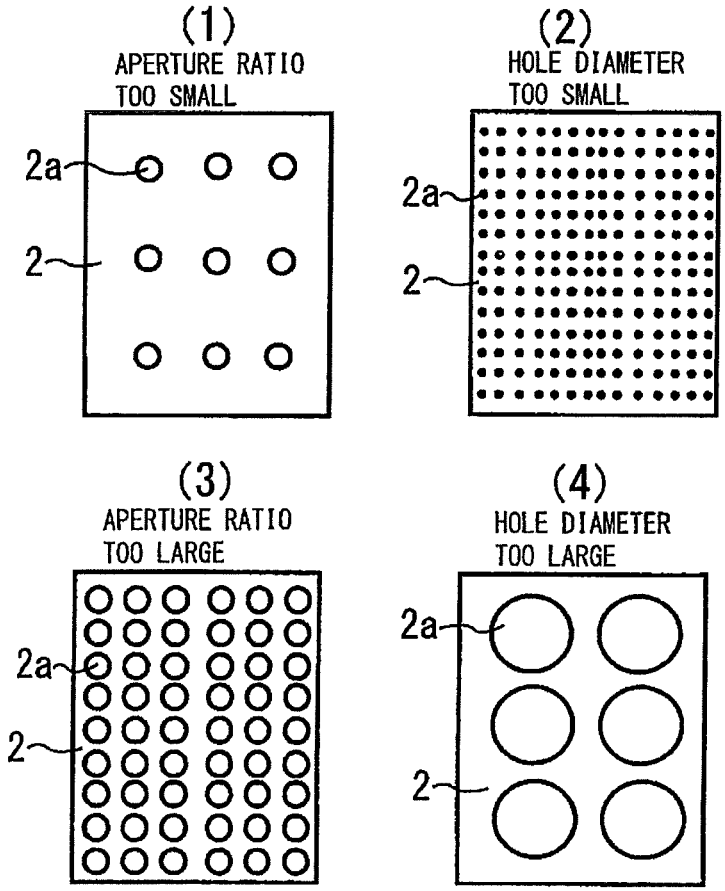

FIG. 8 shows the optimum hole diameter and aperture ratio of the dispersion holes 2*a* of the side members 2. In the graph, (1) to (4) correspond to the figures of (1) to (4) at the bottom. When, as shown in FIG. 8, (1), the side members 2 are too small in aperture ratio or when, as shown in FIG. 8, (2), the dispersion holes 2*a* are too small in hole diameter, the members become close to flat plates and a sufficient dispersion effect cannot be obtained. On the other hand, when, as shown in FIG. 8, (3), the side members 2 are too large in aperture ratio or when, as shown in FIG. 8, (4), the dispersion holes 2*a* are too large in hole diameter, the state becomes close to one where there are no side members 2 and a sufficient dispersion effect cannot be obtained.

In consideration of the above reasons, the inventors ran water model tests. As a result, as shown in FIG. 8, the side members 2 have to have an aperture ratio of 20 to 80%, preferably 30 to 70%, more preferably 40 to 60%. Further, the dispersion holes 2*a* have to have a hole diameter of 5 to 50 mm, preferably 10 to 35 mm, more preferably 15 to 30 mm.

The flow regulating member 10 of the present invention, to secure work efficiency, may also be attached to the edge faces of the coating tank 51 by support members which connect to the flow regulating member 10 and horizontal members which connect to the support members.

EXAMPLES

The flow regulating member 10 of the present invention was placed in an actually operating coating tank 51 and the horizontal plates 1 and side members 2 were made preferred sizes and were set at preferable places so as to confirm the advantageous effects. For the method of confirming the advantageous effects, the dross stir-up index was used in the same way as the water model test. However, the particle size and the number of particles of the bottom dross were visually viewed using an electron microscope rather than a solution particle counter.

Figure 9:
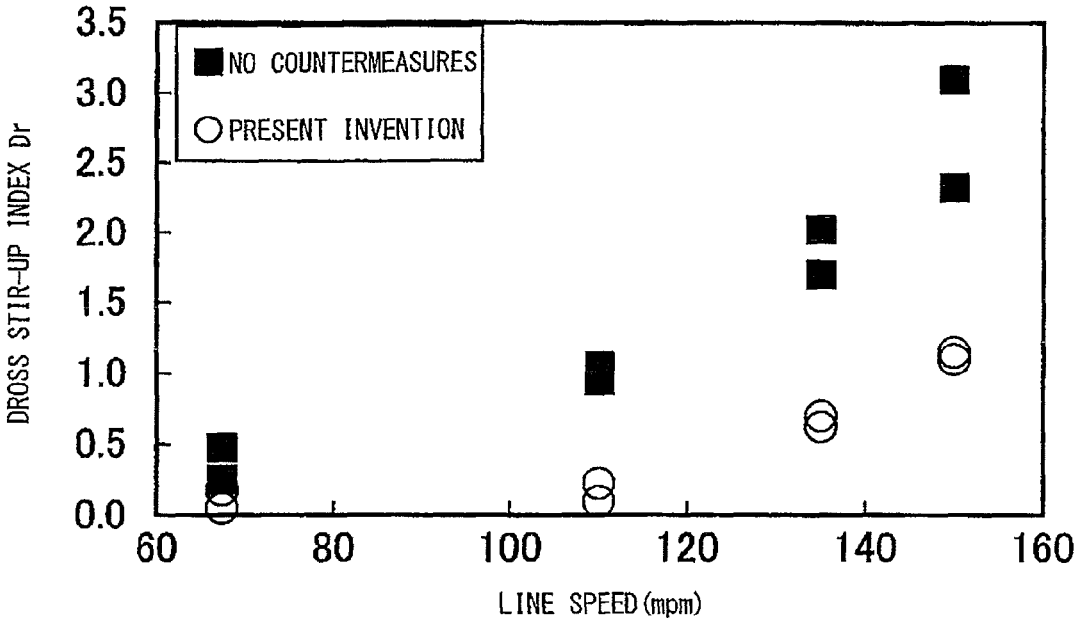
[FIG. 9] A graph which shows the advantageous effects of the present invention.
Figure 10:
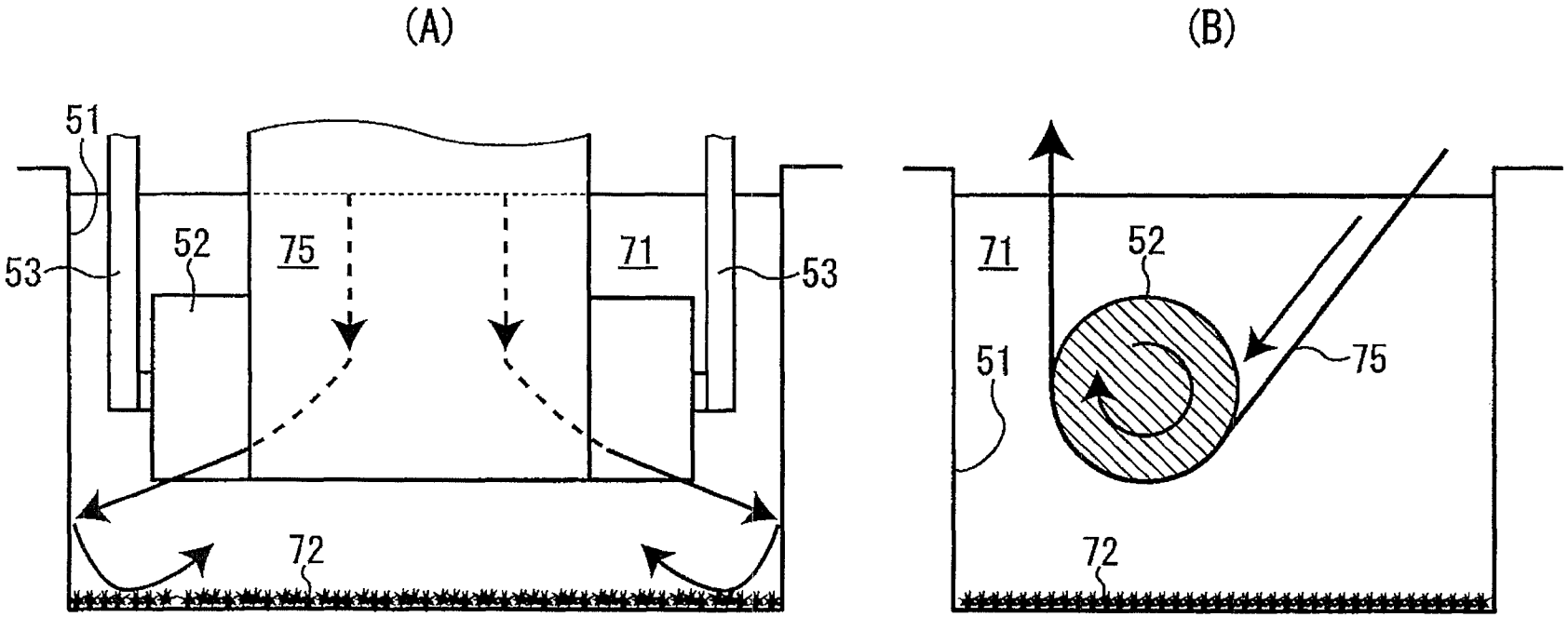
[FIG. 10] An explanatory view of a conventional hot dip galvanizing system.

The results are shown in FIG. 9. FIG. 9 is a graph which compares the dross stir-up indexes when using the dross stir-up index Dr at a line speed of 110 mpm with no countermeasures taken as "1.0". As shown in FIG. 9, it could be confirmed that compared with the case of no countermeasures, by installing the flow regulating member of the present invention, it is possible to great lower the dross stir-up index.

Note that, in the embodiments which were explained above, the molten metal which was filled in the coating tank 51 was molten zinc, but the molten metal is not limited to that. Even if tin, copper, or another molten metal, the technical idea of the present invention can be applied needless to say.

Further, in the embodiments which were explained above, the metal sheet material which was wound around the sink roll 52 and was coated in the coating tank 51 was a steel sheet, but the metal sheet material is not limited to this. Even when coating an aluminum sheet, copper sheet, or other metal sheet material, the technical idea of the present invention can be applied needless to say.

Above, the present invention was explained in relation to embodiments which are believed to be the most practical and preferable at the present point of time. Of course, the present invention is not limited to the embodiments which are disclosed in the description of the present application. The present invention may be suitably changed in a range not contravening the gist or idea of the invention which can be read from the claims or the description as a whole. A flow regulating member of a hot dip coating tank which is accompanied with such changes must be understood as being encompassed by the technical scope.

REFERENCE SIGNS LIST

1 horizontal plate
2 side member
2*a* dispersion hole
3 support member
3*a* horizontal member
3*b* vertical member
10 flow regulating member of hot dip coating tank
51 coating tank
51*a* edge face
52 sink roll
53 roll support member
71 molten zinc
72 bottom dross
73 tracers simulating bottom dross
75 steel sheet

The invention claimed is:

1. A flow regulating member for a hot dip coating tank inside of which a sink roll is arranged in a rotatable manner, the flow regulating member comprising:

horizontal plates respectively arranged horizontally from below two side end parts of the sink roll toward outside directions of the sink roll; and side members arranged at positions separated from the two ends of the sink roll, the side members being perpendicular to the horizontal plates, the side members extending upward from the end parts of the respective horizontal plates, the side members having a plurality of dispersion holes, the side members having an aperture ratio of 20 to 80%, wherein the dispersion holes have a hole diameter of 5 to 50 mm.

2. The flow regulating member for a hot dip coating tank as set forth in claim 1, wherein the side members have an aperture ratio in a range of 30 to 70% and a hole diameter in a range of 10 to 35 mm.

3. A continuous hot dip coating system comprising:

a flow regulating member as set forth in claim 1 or 2;

a sink roll; and a hot dip coating tank.

4. The continuous hot dip coating system as set forth in claim 3, wherein a horizontal direction dimension from bearing parts of the sink roll in a steel sheet exit side direction is 300 mm or more and in that a horizontal direction dimension from bearing parts of the sink roll in a steel sheet entry side direction is 350 mm or more.

5. The continuous hot dip coating system as set forth in claim 3, wherein a separation dimension from a bottom end of the sink roll to said horizontal plates is 100 to 160 mm.

6. The continuous hot dip coating system as set forth in claim 3, wherein the horizontal plates are laid from below the end parts of the sink roll in inside directions of 0 to 15% of a barrel length of the sink roll.

7. The continuous hot dip coating system as set forth in claim 3, further comprising:

a supporting member attaching the flow regulating member to edge faces of the hot dip coating tank.

8. The continuous hot dip coating system as set forth in claim 7, wherein the supporting members comprise a horizontal member and a vertical member.

9. The flow regulating member for a hot dip coating tank as set forth in claim 1 or 2, wherein the horizontal plates are flat plates with no holes.

* * * * *